US005401187A

United States Patent [19]

Ortega

[11] Patent Number: 5,401,187

[45] Date of Patent: Mar. 28, 1995

[54] ELECTRICAL CONNECTOR HOLD DOWN ANCHOR APPARATUS

[75] Inventor: Jose L. Ortega, Louisville, Ky.

[73] Assignee: Robinson Nugent, Inc., New Albany, Ind.

[21] Appl. No.: 131,217

[22] Filed: Oct. 1, 1993

[51] Int. Cl.[6] ..... H01R 13/73

[52] U.S. Cl. ..... 439/567; 411/456; 411/508

[58] Field of Search ..... 439/567, 571; 411/508–510, 913, 456

[56] References Cited

U.S. PATENT DOCUMENTS

| | | | |
|---|---|---|---|
| 3,400,743 | 9/1968 | Strange | 411/913 |
| 3,486,158 | 12/1969 | Soltysik et al. | 411/510 |
| 4,035,874 | 7/1977 | Liljendahl | 411/508 |
| 4,103,400 | 8/1978 | Munse | 411/508 |
| 5,037,327 | 8/1991 | Van Woensel | 439/571 |
| 5,108,308 | 4/1992 | Northcraft et al. | 439/571 |
| 5,171,165 | 12/1992 | Hwang | 439/567 |
| 5,257,947 | 11/1993 | Scheer et al. | 439/567 |
| 5,295,862 | 3/1994 | Mosquera | 439/567 |
| 5,322,452 | 6/1994 | Mosquera | 439/567 |

OTHER PUBLICATIONS

Collins et al., "Surface Mount Connector Hold Downs," InterConnection Technology, pp. 22–23, Aug. 1992.

"Z-Pack 2mm FB (Futurebus+) Connectors," AMP Incorporated, three pages, May 1993.

"Connector Hold Downs," AMP Surface Mount Brochure, p. 21, Oct. 1990.

*Primary Examiner*—Gary F. Paumen

*Attorney, Agent, or Firm*—Barnes & Thornburg

[57] ABSTRACT

An electrical connector hold down apparatus is provided for engaging a side wall defining a hole in a printed circuit board to secure the electrical connector to the printed circuit board. The apparatus includes a base, and a plurality of spring beams extending away from the base. Each spring beam includes a body portion and an anchor tip portion. The anchor tip portions include a ramp surface configured to engage the side wall defining the hole in the printed circuit board and to move the spring beams radially inwardly so that the spring beams apply a radially outwardly directed force against the side wall to hold the apparatus within the hole. The anchor tip portions also include a barb formed on a trailing end of the ramp surface. The barbs are configured to penetrate the side wall defining the hole in the printed circuit board to increase a retention force of the hold down apparatus in the hole.

14 Claims, 2 Drawing Sheets

ELECTRICAL CONNECTOR HOLD DOWN ANCHOR APPARATUS

BACKGROUND AND SUMMARY OF THE INVENTION

The present invention relates to an improved electrical connector hold down anchor apparatus for securing an electrical connector to a printed circuit board (PCB). Connector hold downs are typically used to secure an electrical connector in a predetermined position on a PCB. Such connector hold downs are typically coupled to a connector using various techniques. For instance, it is known to provide top-actuated eyelets, heat stakes, rivets, pinch eyelets, nuts and bolts, or barbed press-fit hold downs for securing the connector to the PCB. Such hold downs typically extend through or engage a hole drilled in the PCB. Connector hold downs reduce stresses on solder joints of surface mount components. Connector hold downs also align the connectors during placement of the connectors on the PCB. In addition, connector hold downs hold the connectors in place for soldering or other operations and can provide a ground path if necessary.

The connector hold down anchor apparatus of the present invention is designed to provide a "process-free" method of mechanically retaining an electrical connector to the surface of a PCB. Process-free methods require that the hold down anchor design not incorporate any secondary assembly operations which must be performed by the customer such as heat-staking a peg or using a nut and bolt hardware to secure the electrical connector to the PCB. The connector hold down anchor apparatus of the present invention is designed to provide maximum reliability and simplicity, while adding the lowest possible applied costs to the connector. The hold down anchor apparatus of the present invention advantageously provides a universal design which works well with various printed circuit board thicknesses and adequately accommodates standard printed circuit board drilled hole manufacturing tolerances without requiring tooling and assembly of several different size components. In the illustrated embodiment, a metallic hold down anchor is provided that can be easily and permanently coupled to a thermoplastic connector body before the connector body is shipped to the customer.

According to one aspect of the present invention, an electrical connector hold down apparatus is provided for engaging a side wall defining a hole in a printed circuit board to secure the electrical connector to the printed circuit board. The apparatus includes a base, and a plurality of spring beams extending away from the base. Each spring beam includes a body portion and an anchor tip portion. The anchor tip portions include a ramp surface configured to engage the side wall defining the hole in the printed circuit board and to move the spring beams radially inwardly so that the spring beams apply a radially outwardly directed force against the side wall to hold the apparatus within the hole.

In the illustrated embodiment, the base of the apparatus is formed to include an aperture therein for receiving a support peg formed on the electrical connector therethrough to couple the base to the electrical connector. The support peg is heat staked after the aperture in the base is inserted over the support peg to couple the base to the electrical connector before the electrical connector is shipped to a customer. Therefore, the customer does not have to perform the staking process to secure the hold down apparatus to the electrical connector.

Also in the illustrated embodiment, the anchor tip portions are curved radially outwardly relative to the base to define a pair of ramp surfaces configured to move the spring beams radially inwardly upon insertion of the spring beams into the hole in the printed circuit board. The anchor tip portions also include a barb formed on a trailing end of the ramp surfaces. The barbs are configured to penetrate the side wall defining the hole in the printed circuit board to increase the retention force of the hold down apparatus with the hole of the printed circuit board.

In the illustrated embodiment, the hold down apparatus includes three spring beams coupled to the base to provide a three point contact with the side wall defining a hole in the printed circuit board to center the hold down apparatus relative to the hole. Preferably, the three spring beams are angularly spaced apart on the base by about 120°.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
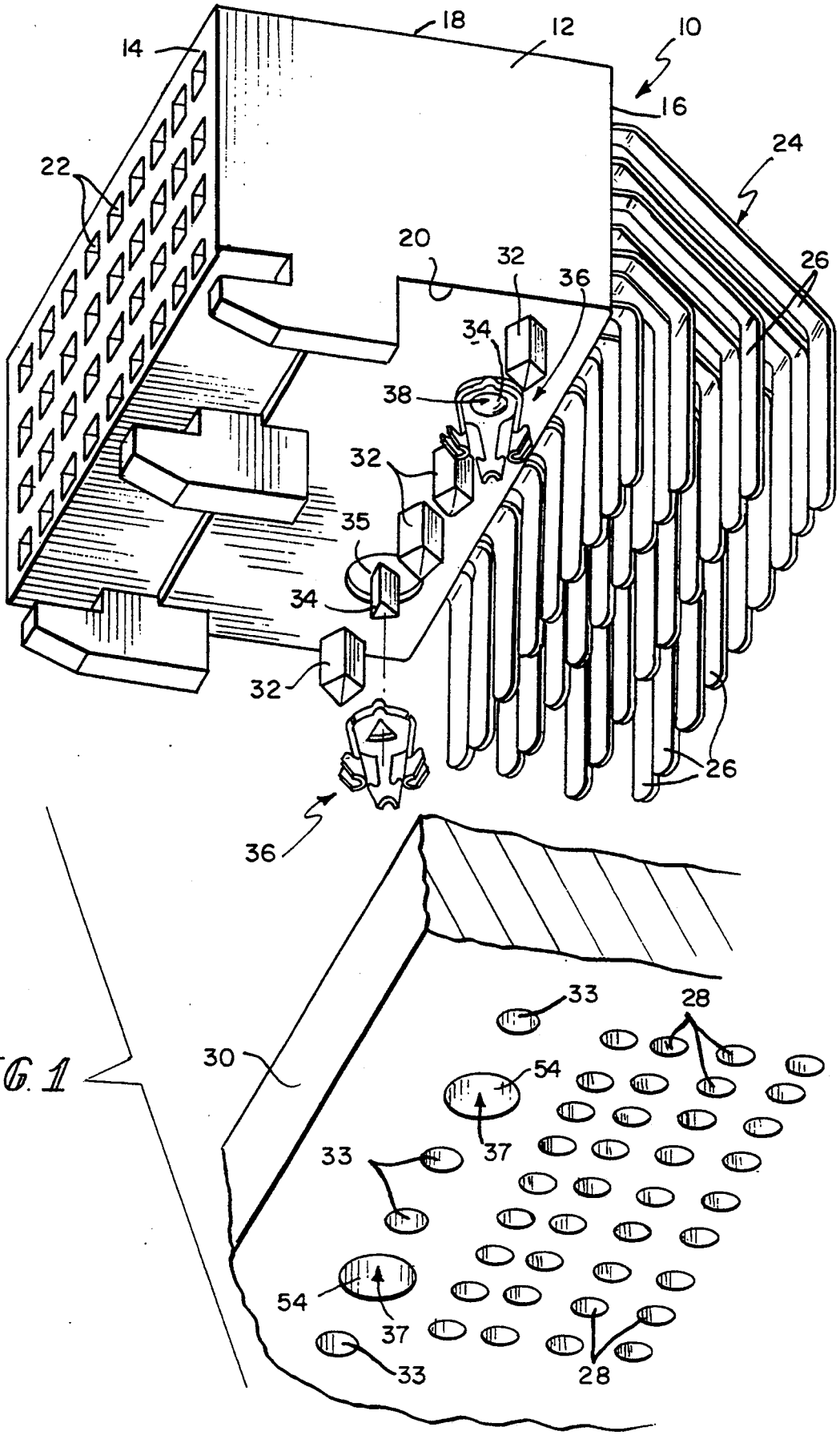
FIG. 1 is an exploded perspective view illustrating an electrical connector configured to be electrically coupled to printed circuit board and a pair of hold down anchors of the present invention for securing the electrical connector to the printed circuit board.
Figure 3:
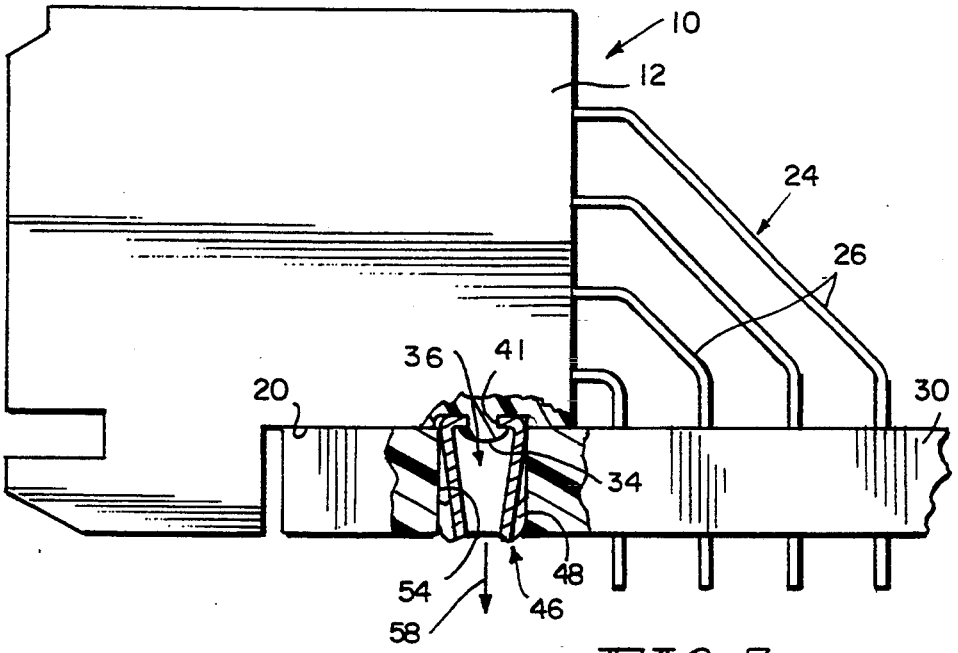
FIG. 3 is a side elevational view with portions broken away illustrating operation of the hold down anchor apparatus of the present invention to secure the electrical connector to the printed circuit board.
Figure 4:
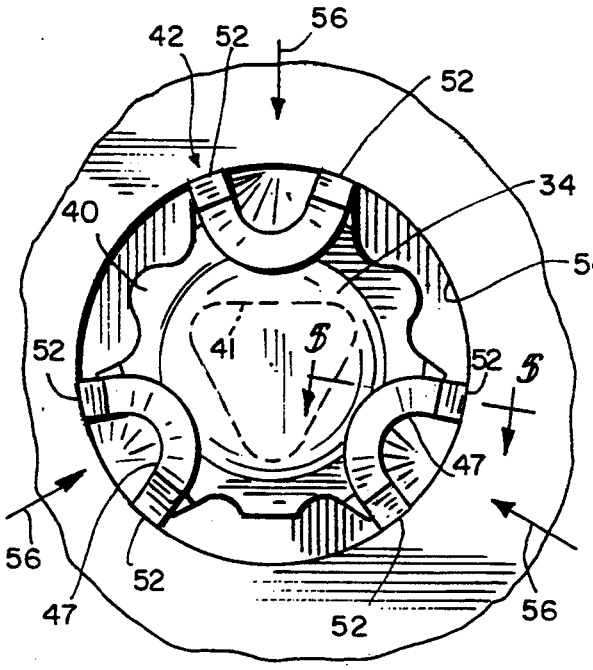
FIG. 4 is a partial bottom view of FIG. 3 illustrating operation of the hold down anchor apparatus inside a drilled hole formed in the printed circuit board.

Referring now to the drawings, FIG. 1 illustrates an electrical connector 10 including a connector housing 12 having a front surface 14, a rear surface 16, a top surface 18, and a bottom surface 20. Housing 12 is formed to include a plurality of pin insertion windows 22 therein for receiving pins of a male header connector (not shown). A plurality of female receptacle contacts 24 are located within housing 12. Receptacle contacts 24 include contact tails 26 configured to be electrically coupled to plated through holes 28 formed in a printed circuit board (PCB) 30 in a conventional manner.

Bottom surface 20 of housing 12 is formed to include a plurality of PCB alignment pegs 32. PCB alignment pegs 32 are configured to enter drilled holes 33 formed in PCB 30 to align connector 10 on PCB 30. Bottom surface 20 is also formed to include a pair of support pegs 34 for aligning a connector hold down anchor apparatus 36 relative to housing body 12 and for securing hold down apparatus 36 to housing body 12 when support peg 34 is heat-staked as illustrated at location 38 in FIG. 1. A recessed portion 35 is formed around each support peg 34 for receiving a base 40 of hold down apparatus 36. Typically, an aperture 41 formed in base 40 of hold down apparatus 36 is placed over each support peg 34 and then the support pegs 34 are heat staked by the connector manufacturer during normal assembly operations to secure hold down apparatus 36 to housing 12. Therefore, hold down apparatus 36 of the present invention does not require the customer to perform the staking process. Each hold down apparatus 36 is configured to enter a drilled hole 37 formed in PCB 30 to secure hold down apparatus 36 and connector 10 to PCB 30.

Figure 2:
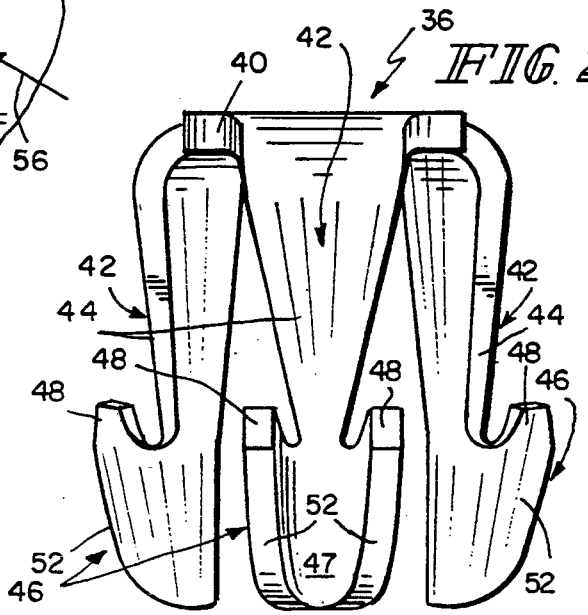
FIG. 2 is a side elevational view of the hold down anchor apparatus of the present invention including three cantilevered beams having anchor tips and pointed barbs formed thereon to provide a triple anchor hold down to secure the electrical connector to the printed circuit board.
Figure 5:
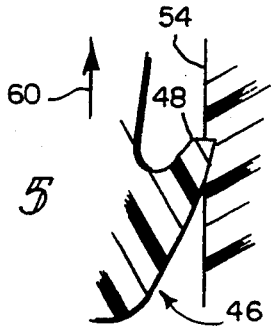
FIG. 5 is a sectional view taken along lines 5—5 of FIG. 4 illustrating a pointed barb of the connector hold down apparatus penetrating a side wall defining the drilled hole in the printed circuit board to increase a retention force of the hold down apparatus, thereby preventing withdrawal of the connector hold down apparatus from the drilled hole of the printed circuit board.

Details of the structure and function of hold down apparatus 36 are illustrated in FIGS. 2–5. FIG. 2 illustrates hold down apparatus 36 which includes a base 40 and three cantilevered spring beams 42 extending away from base 40. Spring beams 42 each include a body portion 44 and an anchor tip portion 46. Body portions 44 are curved radially inwardly toward a center of base 40. Anchor tip portions 46 include a surface 47 which is curved radially outwardly from a center of base 40 and away from body portion 44 to provide a pair of ramp surfaces 52 having barbs 48 formed on a trailing end thereof.

When connector 10 is inserted onto printed circuit board 30, each connector hold down apparatus 36 enters a drilled hole 37 formed in PCB 30 to secure connector 10 to PCB 30. Ramp surfaces 52 located on a radially outward facing surface of anchor tips 46 provide a lead-in ramp surfaces which engage a side wall 54 defining drilled holes 37 as hold down apparatus 36 is inserted into hole 37. Ramp surfaces 52 engage side wall 54 and cause cantilever beams 42 to deflect or move radially inwardly in the direction of arrows 56 of FIG. 4 as hold down apparatus 36 is inserted into drilled holes 37. Spring beams 42 provide a radially outwardly directed spring force against side wall 54 to retain and center hold down apparatus 36 inside drilled hole 37. The upwardly pointed barbs 38 permit hold down apparatus 36 to be easily inserted into drilled holes 37 in the direction of arrow 58 of FIG. 3. However, as illustrated best in FIG. 3 and 5, pointed barbs 48 tend to penetrate, cut into, or interfere with side wall 54 defining drilled holes 37 when an attempt is made to move connector 10 in the direction of arrow 60 in FIG. 5. In other words, when an attempt is made to extract connector 10 and hold down apparatus 36 from PCB 30, pointed barbs 48 extending radially outward from the anchor tip portions 46 of each spring beam 42 penetrate the inner side wall 54 defining hole 27 in printed circuit board 30, thereby increasing a retention force of hold down apparatus 36 within hole 37 of PCB 30 and preventing removal of apparatus 36 from hole 37.

The radially oriented cantilever beams 42 of hold down apparatus 36 permit the use of a greater number of retention barbs 48 than with conventional barbed hold downs. In addition, providing three cantilevered spring beams spaced 120° apart provides a three point contact between hold down apparatus 36 and side wall 54 to align hold down apparatus 36 within drilled hole 37 automatically. Drilled holes 37 are the easiest technique available to penetrate fiberglass reinforced type PCB material. Therefore, using drilled holes is the most widely used approach for mechanically fastening components to PCBs. The use of cantilever spring beams 42 on hold down apparatus 36 of the present invention advantageously permits hold down apparatus 36 to adjust for tolerances in the size of drilled holes 37 automatically while maintaining lower insertion force. Ramp surfaces 52 permit hold down apparatus 36 to be inserted into holes that vary slightly in size without changing to a different size hold down apparatus 36.

Advantageously connector hold down apparatus 36 of the present invention can be economically manufactured using commonly available metal stamping and forming technology. Alternatively, a connector hold down apparatus similar to the apparatus illustrated in FIGS. 1–5 can be incorporated within the thermoplastic connector body.

Although the invention has been described in detail with reference to a certain preferred embodiment, variations and modifications exist within the scope and spirit of the invention as described and defined in the following claims.

What is claimed is:

1. An electrical connector hold down apparatus for engaging a side wall defining a hole in a printed circuit board to secure the electrical connector to the printed circuit board, the apparatus comprising:

a base; and at least two spring beams extending away from the base, each spring beam being configured to apply a radially outwardly directed force against the side wall defining the hole in the printed circuit board, each spring beam including a body portion and an anchor tip portion, the anchor tip portions being bent with respect to the central axis of the hole so as to curve radially outwardly relative to the base to define a pair of ramp surfaces for moving the spring beams radially inwardly upon insertion of the spring beams into the hole in the printed circuit board, each ramp surface being formed to include a barb configured to penetrate the side wall defining the hole in the printed circuit board to increase a retention force of the hold down apparatus in the hole.

2. The apparatus of claim 1, wherein the base is formed to include an aperture therein for receiving a support peg formed on the electrical connector therethrough to couple the base to the electrical connector.

3. The apparatus of claim 2, wherein the support peg is heat staked after the aperture in the base is inserted over the support peg to couple the base to the electrical connector.

4. The apparatus of claim 1, wherein the barbs are formed on a trailing end of each ramp surface.

5. The apparatus of claim 1, wherein the apparatus includes three said spring beams coupled to the base to provide a three point contact with the side wall defining a hole in the printed circuit board to center the hold down apparatus relative to the hole.

6. The apparatus of claim 5, wherein the three spring beams are angularly spaced apart on the base by about 120°.

7. An electrical connector hold down apparatus for engaging a side wall defining a hole in a printed circuit board to secure the electrical connector to the printed circuit board, the apparatus comprising:

a base; and three cantilevered beams extending away from the base, each cantilevered beam including a body portion and an anchor tip portion, each anchor tip portion being bent with respect to the central axis of the hole so as to curve radially outwardly relative to the base to define a pair of ramp surfaces for engaging the side wall defining the hole in the printed circuit board to move the cantilevered beams radially inwardly as the connector upon insertion of the cantilevered beams into the hole in the printed circuit board so that the cantilevered beams apply a radially outwardly directed force against the side wall to hold the apparatus within the hole, the ramped surfaces being formed to include a barb configured to penetrate the side wall defining the hole in the printed circuit board due to the radially outwardly directed force applied by the cantilevered beams to increase a retention force of the hold down apparatus in the hole.

8. The apparatus of claim 7, wherein the base is formed to include an aperture therein for receiving a support peg formed on the electrical connector therethrough to couple the base to the electrical connector.

9. The apparatus of claim 8, wherein the support peg is heat staked after the aperture in the base is inserted over the support peg to couple the base to the electrical connector.

10. The apparatus of claim 7, wherein the three cantilevered beams are angularly spaced apart on the base by about 120°.

11. An electrical connector hold down apparatus for engaging a side wall defining a hole in a printed circuit board to secure the electrical connector to the printed circuit board, the apparatus consisting essentially of:

a base; and a plurality of spring beams extending away from the base, each spring beam including a body portion and an anchor tip portion, each anchor tip portion being bent with respect to the central axis of the hole so as to curve radially outwardly of the base to define a pair of ramp surfaces configured to engage the side wall defining the hole in the printed circuit board and to move the spring beams radially inwardly so that the spring beams apply a radially outwardly directed force against the side wall to hold the apparatus within the hole.

12. The apparatus of claim 11, wherein the anchor tip portions also include a barb formed on a trailing end of the ramp surface, the barbs being configured to penetrate the side wall defining the hole in the printed circuit board to increase a retention force of the hold down apparatus in the hole.

13. The apparatus of claim 11, wherein the apparatus includes three said spring beams coupled to the base to provide a three point contact with the side wall defining a hole in the printed circuit board to center the hold down apparatus relative to the hole.

14. The apparatus of claim 13, wherein the three spring beams are angularly spaced apart on the base by about 120°.

* * * * *